US006196351B1

(12) United States Patent
Clokey et al.

(10) Patent No.: US 6,196,351 B1
(45) Date of Patent: Mar. 6, 2001

(54) SILENCER CARTRIDGE

(75) Inventors: Neville Julian Clokey; George Christopher Frederick Balmer, both of Lancs (GB)

(73) Assignee: Lancaster Glass Fibre Limited, Lancaster (GB)

( * ) Notice: Subject to any disclaimer, the term of this patent is extended or adjusted under 35 U.S.C. 154(b) by 0 days.

(21) Appl. No.: 09/326,156

(22) Filed: Jun. 4, 1999

(51) Int. Cl.[7] ..... F01N 1/10
(52) U.S. Cl. ..... 181/252; 181/256; 181/282
(58) Field of Search ..... 181/282, 252, 181/256, 258, 264, 227, 228, 247

(56) References Cited

U.S. PATENT DOCUMENTS

| | | | | |
|---|---|---|---|---|
| 2,937,707 | * | 5/1960 | Ernst | 181/42 |
| 3,521,429 | * | 7/1970 | Leffler | 55/276 |
| 4,211,303 | | 7/1980 | Matthews et al. . | |
| 4,211,305 | | 7/1980 | Matthews et al. . | |
| 4,234,054 | | 11/1980 | Chapin . | |
| 4,316,523 | * | 2/1982 | Boretti | 181/226 |
| 4,513,841 | * | 4/1985 | Shimoji et al. | 181/252 |
| 4,580,656 | * | 4/1986 | Fukuda | 181/252 |
| 4,598,790 | * | 7/1986 | Uesegi et al. | 181/252 |
| 5,365,025 | * | 11/1994 | Kraai et al. | 181/249 |
| 5,670,756 | * | 9/1997 | Ohtaka et al. | 181/256 |
| 5,718,045 | | 2/1998 | Tsukahara et al. . | |
| 5,783,780 | * | 7/1998 | Watanabe et al. | 181/229 |
| 5,926,954 | | 7/1999 | Wolf et al. . | |
| 5,992,560 | * | 11/1999 | Matsuoka et al. | 181/252 |

FOREIGN PATENT DOCUMENTS

| | | | |
|---|---|---|---|
| 32 05 185 A1 | | 8/1983 | (DE) . |
| 33 04 809 A1 | | 8/1984 | (DE) . |
| 38 05 469 C1 | | 9/1988 | (DE) . |
| 195 17 364 A1 | | 11/1996 | (DE) . |
| 0 783 164 A2 | | 7/1997 | (EP) . |
| 704329 | | 2/1954 | (GB) . |
| 2 267 731 | | 12/1993 | (GB) . |
| 06261186 | | 4/1996 | (JP) . |
| 10077823 | | 3/1998 | (JP) . |
| 730996 | | 4/1980 | (SU) . |
| 985345 | | 12/1982 | (SU) . |
| 985344 | * | 12/1982 | (SU) ..... F01N/1/00 |

* cited by examiner

*Primary Examiner*—Robert E. Nappi
*Assistant Examiner*—Edgardo San Martin
(74) *Attorney, Agent, or Firm*—Jenkins & Wilson, P.A.

(57) ABSTRACT

A silencer for a vehicle exhaust assembly is described. The silencer comprises an outer wall, a porous exhaust pipe which defines an inner wall and a sound absorbent fibrous material located between the inner and the outer wall. The sound absorbent fibrous material is substantially unidirectional and parallel with the direction of gas flow through the porous exhaust pipe. The fibre is enclosed in a silencer cartridge. A method of producing such a cartridge is also described.

20 Claims, 3 Drawing Sheets

SILENCER CARTRIDGE

TECHNICAL FIELD

The present invention relates to a silencer cartridge and particularly, although not exclusively, to a silencer cartridge or a silencer in a vehicle exhaust assembly. The invention also extends to a silencer which includes such a silencer cartridge.

BACKGROUND OF THE INVENTION

The silencer of a vehicle exhaust assembly may comprise an outer wall and porous exhaust pipe which defines an inner wall of an annular cavity. Typically, the cavity is randomly packed with sound absorbent material, for example, a glass fibre or basalt fibre material is positioned around the perforated pipe so as to fill the void between the pipe and the outer wall of the silencer and absorb sound waves which pass thereinto.

Since sound absorbent material in the form of glass fibre and basalt fibre is unpleasant to handle, suppliers of such fibrous materials supply the material to vehicle exhaust manufacturers in a suitably shaped and sized pack which is then inserted into the cavity of the silencer. Although the inner wall of the silencers are typically circular in cross section, the outer wall may be circular or oval and, increasingly, the oval outer wall is becoming more common. Numerous attempts have been made to improve the acoustic performance of silencers and it is one of the objects of the present invention to provide a silencer with a silencer cartridge with an improved acoustic performance.

A further problem with silencers of this type is that they are continuously subjected to directional gas flow which tends, over the course of time, to pack down the sound absorbent material or blow it out of the silencer altogether. Furthermore, the sound absorbent material is constantly vibrated so that the silencer material loosens over time and any structure present in the material collapses. The vibrational forces together with the uni-directional flow of gas through the silencer cause rapid degradation of the sound absorbent material leading to the necessity for its eventual replacement. It is a further object of the present invention to overcome these problems.

A still further problem with existing silencers, is that they are typically random packed with sound absorbent material. The random packing process tends to lead to a relatively wide variation in packing densities leading to difficulties in re-producibility and quality control in the final silencer product.

It is a still further object of the present invention to overcome this problem.

U.S. Pat. No. 5,670,756 discloses a silencer with the sound absorbing material wound directly around the outside of the inner sleeve with two or more turns so that the thickness of wound sound absorbing material around the inner sleeve is greater than the dimension of the gap between the inner sleeve and the outer sleeve to give an interference fit between the sound absorbing material and the inner and outer sleeves. The sound absorbing material with the inner sleeve is press fitted into the outer sleeve. The sound absorbing material is prevented from being blown out by exhaust gas flowing through the inside of the inner sleeve so that the silencer is improved in durability. This is provided by the press-fitting of the sound absorbent material which prevents vibration of the sound absorbing material during use. In addition, some stability in density is achieved by this technique compared with random packed silencers. However, although the vibrational problem is reduced, no attempt is made to solve the problem of the long term effect of uni-directional gas flow on the sound absorbing material.

U.S. Pat. No. 5,718,045 describes a similar technique where a sound absorbing material is formed of a heat-resistant fibre layer which is wound around an outer peripheral surface of the porous inner pipe with a binder interposed therebetween, and an outer peripheral surface of the heat-resistant fibre layer is press-fitted to an inner peripheral surface of the outer pipe with a predetermined interference. However, again, no attempt is made to address the problem of silencer degradation due to uni-directional gas flow.

BRIEF SUMMARY OF THE INVENTION

According to a first aspect of the present invention there is provided a silencer for a vehicle exhaust assembly comprising an outer wall, a porous exhaust pipe which defines an inner wall and a sound absorbent fibrous material located between the inner and the outer wall, wherein the sound absorbent fibrous material is substantially unidirectional and parallel with the direction of gas flow through the porous exhaust pipe.

According to a second aspect of the present invention there is provided a silencer cartridge for packing into the cavity between the inner and outer wall of a silencer comprising sound absorbent fibrous material which is substantially unidirectional, the cartridge being capable of being inserted into a cavity between the inner and outer wall of a silencer in such a manner that the direction of the fibres is substantially parallel with the direction of gas flow through the silencer.

Preferably, the cartridge includes an outer casing to hold the fibrous material in the shape required. Preferably, the casing is made from a flexible material such as needlemat.

Preferably, the cartridge has a hollow tubular core designed to be close fitting with the outer wall of an exhaust pipe tube.

Preferably, the fibres are repeatedly wrapped around and directed back at the longitudinal limits of the said unidirectional fibres so that substantially endless unidirectional fibres are present.

Preferably, the wrapping of the fibres is carried out in such a manner that successive fibres are generally displaced laterally from the previously wrapped fibre so that a continuous bed of fibres is built up.

Preferably, the bed of fibres is formed by wrapping substantially continuous fibre around a bed shaped former, beginning at one end thereof and gradually turning the fibres around the former and displacing fibres along the former until a bed of fibres is built up. Thereafter, a bed of fibres may be removed from the former so that a folded bed of unidirectional fibres is formed.

The bed of fibres so formed may be easily shaped along the axis perpendicular to the direction of the fibres to fill a correspondingly shaped cavity on a silencer.

Accordingly, the sound absorbent material comprises a unidirectional substantially continuous structure, preferably formed by repeatedly folding the unidirectional fibres back in the opposite direction at the longitudinal limits of extension of the fibres and, preferably, generally directing successive fibres slightly laterally so that a bed of fibres is built up.

Preferably, at least some of the fibres in the product are directed slightly laterally with respect to the substantial direction of the fibres. Preferably, the fibres are continuous and folded back in the opposite direction at the longitudinal limit of the cartridge. Preferably, the fibres are repeatedly folded back in the opposite direction as they successively meet the longitudinal limit of the cartridge.

Advantageously, the unidirectional fibres are found to have improved sound absorbing characteristics when parallel with the gas flow through the silencer. It is not conclusively clear why the directional fibre has better acoustics than randomly packed fibre but this may be due to the closer packing of the fibres which is possible with directional fibre. The unidirectional nature of the fibre bed allows the use of higher packing densities closer to the gas flow than has previously been considered practical. This is especially significant in promoting the locational stability of the fibrous sound absorbing material and resistance to vibration.

Furthermore, the circumferential geometry of the fibre bed allows the density of the fibrous sound absorbing material to be controlled in a manner proportional to the depth of the material. The ultra high packing density close to the central aperture of the cartridge is progressively reduced, as a function of the cartridge depth, towards the point of contact with the inside of the outer shell. Such change in density is subtle, so that the density throughout the fibrous bed remains relatively high with the net density of the fibrous bed typically being maintained between 165 $kg/m^3$ and 170 $kg/m^3$. Control of the density in this manner maximises the acoustic absorption capabilities of the silencer cartridge per unit volume of sound absorbing material.

Furthermore, the directional fibres produce more closely reproducible acoustic characteristics than randomly packed sound absorbing materials. Still further, in many applications the cavity between the outer and inner wall of the silencer is of oval outer wall cross-section and although the inner wall still generally defines a circular tube, the unidirectional bed of fibres is uniquely adapted to be shaped to fit into any cross-sectional shape of cavity including such an oval cross-section. In such a silencer the outer oval casing and inner circular casing cause the cavity to be wider across the longer dimension of the oval and narrower across the shorter dimension of the oval. Accordingly, when shaped into an oval cross-section the bed of directional fibres forms a high density area across the shorter dimension of the oval and a lower density area across the wider dimension. The high density area is particularly useful in absorbing low frequency noise whereas the lower density area may absorb high frequency noise, although in practice the density would be such as to allow both types of noise to be absorbed across both dimensions with an improved absorption of low density noise across the narrower dimension.

A still further advantage of the invention is the reduction in loss of fibre or post manufacture bedding down of the material caused by the directional gas flow through the silencer. This reduction in loss of fibre is possible because the fibres are parallel with the direction of gas flow and, consequently, less likely to be orientated and packed by the directional gas flow. This ensures minimal disturbance of the fibre bed from pressure pulses and promotes silencer durability. The advantage is further improved by the folding back of the fibres as fibres with cut-ends would be more likely to be blown out of the silencer over time and also would be more likely to bed down as a result of the directional gas flow.

The generally high density packing possible with the directional fibre bed reduces the fibre vibration magnitude during sound absorption and this further reduces wear and tear on the bed and prolongs the life of the silencer.

One further advantage of the fibre bed is the possibility for a net reduction in the volume occupied by the sound absorbing packing material within the silencer casing in order to achieve a given acoustic performance level, compared with the volume required using packing methods based on random fibre distribution. This is particularly useful where a number of cartridges are required for a particular silencer cartridge as it is possible to leave a void between successive cartridges due to the high performance of the cartridges fitted and ultimately this reduces the number of cartridges required for a particular silencer.

Preferably, the fibre lengths are wrapped around the former to form a bed of unidirectional wrapped fibres at least once, more preferably, at least twice.

Preferably, the fibre lengths are wrapped around the former by traversing the former in one direction and then returning to the original position to give a second fibre coating.

Preferably, the bed is formed from a substantially continuous length of fibres, however, it is possible that a number of lengths could be utilised even where the wrapped/folded fibres are utilised so long as the directional fibres are substantially wrapped/folded along the length of the bed. Inevitably, during manufacture, there may be imperfect lengths of fibres and a number of additional fibre ends may inevitably be present in the final bed but this will not detract from the advantage of the folded fibres so long as they are substantially folded.

Preferably, a mat is located around the outer wall of the fibre bed. The mat may be used to assist with forming of the bed into the desired cross-sectional shape for the cavity and/or to hold the shape of the formed bed. Preferably, the mat is sealed to hold the fibre bed in a pack/cartridge ready for insertion into a silencer cavity.

Preferably, the mat is produced from a suitably flexible material. The mat may be formed from glass fibre, more preferably, flexibly bonded glass fibre. A suitable material is glass fibre needlemat.

Advantageously, the mat may be accurately dimensioned to enable insertion into silencer casings by automated or semi-automated means. The mat also provides protection for the fibrous core during handling, shipping and installation. Preferably, the mat is designed and produced from a material which will provide effective damping of the silencer casing during operation, preventing both acoustic flanking and the transmission of vibration to the fibre core.

Preferably, the fibres are sprayed with a suitable binder such as silicate or other suitable material to assist with formation of the shaped bed. Preferably, the formed bed is heated prior to use to help mould it into the desired shape.

Advantageously, during packing of the fibre layer into the cavity the directional nature of the fibres in the layer reduces disturbance of the layer.

It is envisaged that the fibre layer may be slid directly into a silencer cavity and capped in a semi-automated or automated way.

The invention will now be described, by way of example, with reference to the accompanying drawings in which:

DETAILED DESCRIPTION OF THE INVENTION

Figure 1:
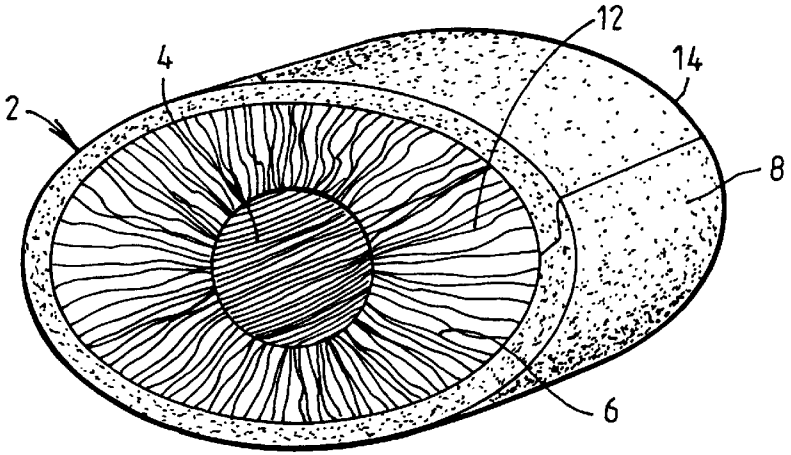
FIG. 1 shows a silencer cartridge in accordance with the present invention.

Referring to FIG. 1, the silencer cartridge 2 comprises a hollow tubular core 4 suitable for receiving a porous gas exhaust pipe (not shown), fibrous sound absorption layer 6 surrounding the central tubular core 4 and an outer needlemat holding shell 8 surrounding the fibrous layer. The outer needlemat shell 8 is of a shape which is suitable to be placed within the outer wall of a silencer (not shown). The dimensions of the central tubular core 4 and the outer shell 8 are such as to provide a friction fit between the outer and inner wall of a silencer cavity.

Figure 2:
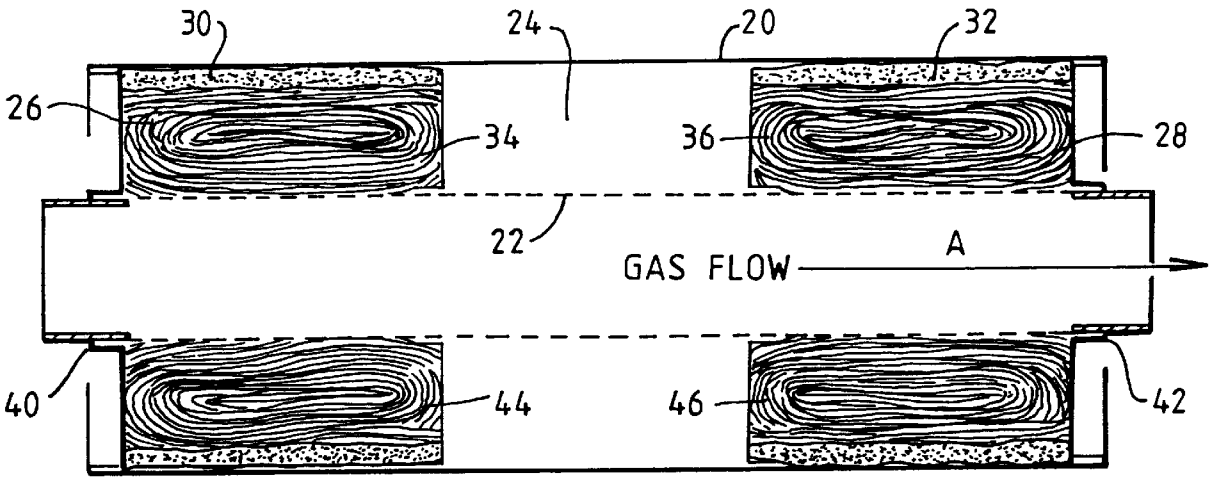
FIG. 2 shows a cross-section through a silencer having two silencer cartridges in accordance with the present invention.

The fibrous sound absorption layer 6 comprises a continuous glass fibre which has been wrapped around and along a former in a unidirectional manner to provide a plurality of the unidirectional fibres surrounding the central tubular core and aligned with the direction of gas flow. The front 12 and rear face 14 of the cartridge 2 provide the longitudinal limits of the fibres and have been flattened in the production process and comprise the folded ends of the unidirectional fibres. It can be seen from FIG. 1 that the density of the unidirectional fibres at the interface with the central tubular core 4 is greater than at the interface with the inner wall of the outer shell 8. Preferably, the density of the fibres at the interface with the central tubular core is greater than 180 kg/m$^3$, more preferably it is greater than 200 kg/m$^3$. The structure of the fibrous sound absorption layer may also be seen from FIG. 2. In FIG. 2, a cross-section is shown through a silencer having an outer wall 20 and a central perforated tube 22 through which the exhaust gases flow in the direction of the arrow A. The cavity 24 between the outer wall 20 and the porous exhaust tube 22 is not completely filled with sound absorption material but has placed therein two spaced silencer cartridges 26, 28. Each cartridge has the same structure as that described for the cartridge in FIG. 1 and the cross-section shows the outer needlemat shell 30, 32 and the fibrous sound absorption layer located between the outer shell 30, 32 and the perforated exhaust tube 22. Each cartridge abuts on one face respective end caps 40, 42 of the silencer shell and includes respective holding caps 44, 46 on its opposite face which may be welded or push fitted into the cavity 24 to hold the cartridge against the end caps of the silencer body and in place within the cavity 24. The high efficiency of the silencer cartridges of the present invention allow for the possibility of the use of two cartridges spaced apart and abutting the respective ends of the silencer casing as opposed to three cartridges for which the cavity space is designed. The cross-section through the silencer cartridge shows, schematicaly, the structure of the folded continuous fibre which builds up from a central position outwardly which reflects the windings of the continuous fibre around the former during production. It can be seen that no significant voids are present in the fibrous bed which is due to the number of windings around the former and the interference fit of the fibrous bed within the fibremat casing 30, 32.

Figure 3A:
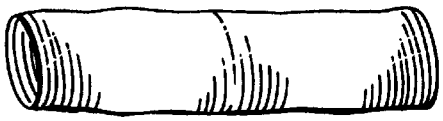
FIGS. 3*a–c* shows three stages in the formation of the central fibrous core in accordance with the invention.
Figure 3B:
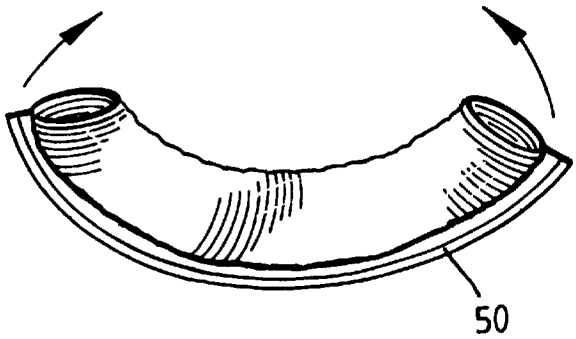
Figure 3C:
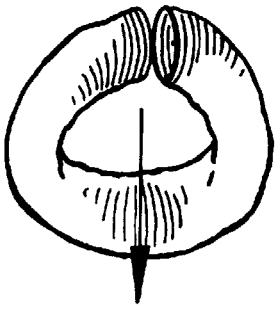

The method of production of the silencer cartridge is best described with reference to FIGS. 3*a–c*. FIG. 3*a* shows the continuous glass fibre bed immediately after the continuous glass fibre has been wrapped around the former (not shown) and the former removed from the center of the bed. Typically, at least two complete wrappings of the former are carried out to provide a suitably thick bed of continuous wrapped fibre. After removal from the former the bed of wrapped fibres is shaped and encased in a needlemat 50 to hold the fibre layer in the required shape for the silencer cartridge. The upper surface of the bed is formed so that it adopts a shape which is suitable for receiving a gas exhaust tube of a silencer. The manner of folding the bed of fibres is shown in FIG. 3*b* and it can be seen that the bed is folded along its longitudinal axis so that the unidirectional fibres remain parallel with the direction of gas flow through the core of the silencer as depicted in FIG. 3*c*. Referring to FIG. 3*c*, the diameter of the core of the silencer is necessarily smaller than the diameter of the outer casing and, accordingly, the unidirectional fibres are more densely packed around the core of the silencer than at the interface with the needlemat and outer casing of the silencer. The compression of the unidirectional fibres around the core in this manner leads to a significant increase in the density of the fibrous material which comes into immediate contact with the exhaust gases.

Figure 4:
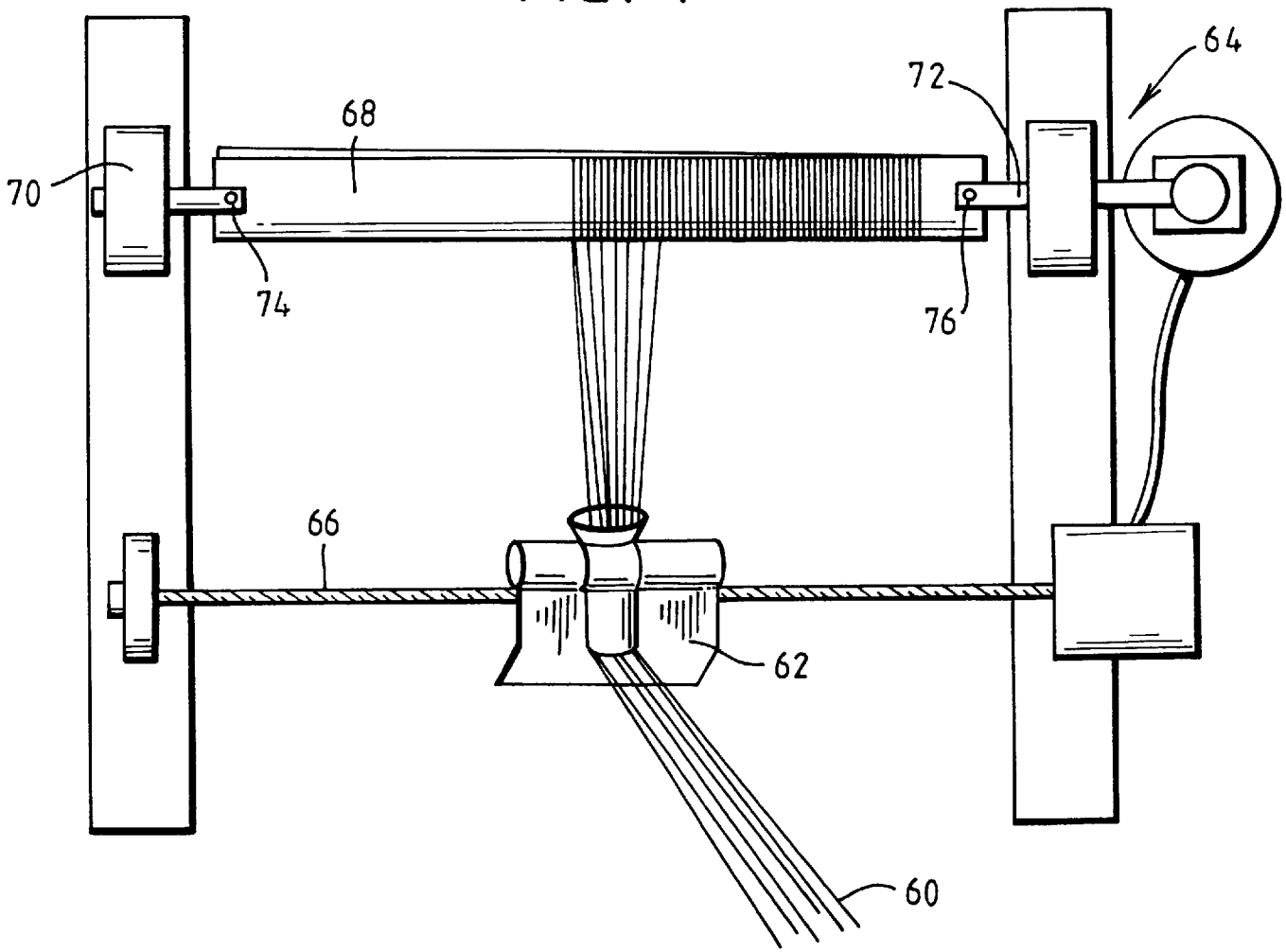
FIG. 4 shows a schematic view of a suitable forming device in accordance with the present invention.

Referring to FIG. 4, the continuous glass fibre 60 enters the distribution head 62 of the forming apparatus 64. The distribution head is mounted on a reversing rotating screw drive shaft 66 in such a manner that a timed operation of the screw drive shaft causes the distribution head to reciprocate along the axis of the screw drive shaft which allows the continuous glass fibre to be distributed along the length of the former 68.

The former 68 is keyed to respective spindles 70, 72 located at either end thereof using locating pegs 74, 76. Spindle 70 is driven by a suitable motor and the speed of the motor is synchronized to the speed of the screw shaft which drives the distribution head. Rotation of the former about its axis causes deposition of the continuous glass fibre on the former in a unidirectional manner. Simultaneously, reciprocating movement of the distribution head along the axis of the screw drive shaft causes the continuous glass fibre to be deposited along the length of the former. Typically, deposition of the continuous glass fibre is commenced at one end of the former and continued for a single outward and return journey so that two passes of the distribution head are used to deposit the required quantity of continuous glass fibre onto the former. Synchronisation of the spindle motor and the speed of the screw shaft are essential to achieve the measured deposition of fibre over the length of the former in the uniformity of manner required. The length of continuous glass fibre to be deposited on the former may be measured to enable the qualification of the weight of the fibrous core to be pre-determined.

A suitable measuring device (not shown) causes the apparatus to switch off automatically once the measured length of fibrous glass has been deposited onto the former. At this point, the former is removed from the locating pegs on the spindles in preparation for removal of the unidirection fibrous bed from the former. When mounted on the locating pegs, the two aluminium blades of the former are designed to pivot at one end and close the small gap between the faces of the blades which is present at the other end when the blades are rotating on the former. The faces of the blades oppose each other, pivoted at one end and spring loaded so that they are urged towards a closed position where each blade face is located against the other. When the blades are mounted on the locating pegs, they are slightly held apart at one end in a splayed position which is appropriate for the formation of the continuous fibre bed. After removal from the locating pegs, the faces of the blades pivot towards each other and are, thereby, easily removed from the unidirectional fibrous sock without incurring any distortion of the unidirectional fibres.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A silencer for a vehicle exhaust assembly comprising an outer wall, a porous exhaust pipe which defines an inner wall and a sound absorbent fibrous material located between the inner and the outer wall, wherein the fibres of the sound absorbent fibrous material are substantially unidirectional and parallel with the direction of gas flow through the porous exhaust pipe.

2. A silencer cartridge for packing into the cavity between the inner and outer wall of a silencer comprising sound absorbent fibrous material which is substantially unidirectional, the cartridge being capable of being inserted into a cavity between the inner and outer wall of a silencer in such a manner that the direction of the fibres is substantially parallel with the direction of gas flow through the silencer.

3. A silencer cartridge according to claim 2, wherein the cartridge includes an outer casing to hold the fibrous material in the shape required.

4. A silencer according to claim 3, wherein the casing is made from a flexible material.

5. A silencer cartridge according to claim 2, wherein the cartridge has a hollow tubular core designed to be close fitting with the outer wall of an exhaust pipe tube.

6. A silencer cartridge according to claim 2, wherein fibres are repeatedly wrapped around and directed back at the. longitudinal limits of the said unidirectional fibres so that substantially endless unidirectional fibres are present in the pack.

7. A silencer cartridge according to claim 6, wherein the wrapping of the fibres is carried out in such a manner that successive fibres are generally displaced laterally from the previously wrapped fibre so that a continuous bed of fibres is built up.

8. A method of producing a silencer cartridge comprising the steps of:

repeatedly wrapping fibres around and progressively along an elongate former so that a bed of unidirectional wrapped fibres is produced;

removing the former from the bed of fibres;

shaping the bed of folded fibres along its longitudinal axis into a shape suitable for a silencer cartridge.

9. A method according to claim 8, wherein the fibres are substantially continuous.

10. A method according to claim 8, wherein the bed may be shaped around a further former during shaping so that a hollow core is formed suitable for receiving an exhaust gas pipe.

11. A method according to claim 8, wherein the former has two parallel elongate opposed edges about which the fibres are wrapped during turning of the fibre around the former.

12. A method according to claim 11, wherein the fibres are introduced to the edges of the former substantially perpendicular thereto.

13. A method according to claim 11, wherein the opposed edges or faces of the former are moveable relative to each other between a first position which allows formation of the fibrous bed and a second position which eases removal of the former from the fibrous bed.

14. A silencer cartridge according to claim 2, wherein the net density of the fibre core of the silencer cartridge is between 100 $kg/m^3$ and 200 $kg/m^3$.

15. A silencer cartridge according to claim 4, wherein the outer casing has a density of between 80 $kg/m^3$–180 $kg/m^3$.

16. A method according to claim 8, wherein at least two complete wrappings of the former are carried out to provide a suitable thick bed of continuous wrapped fibre.

17. A silencer cartridge according to claim 2, wherein the sound absorbent fibrous material is formed by wrapping substantially continuous fibre around a bed shaped former, beginning at one end thereof and gradually turning the fibres around the former and displacing the fibres along the former until a bed of fibres is built up.

18. A silencer cartridge according to claim 17, wherein the bed of fibres so formed may be easily shaped along the axis perpendicular to the direction of the fibres to fill a correspondingly shaped cavity on a silencer.

19. A silencer cartridge according to claim 2, wherein the fibres are continuous and folded back in the opposite direction at the longitudinal limit of the cartridge.

20. A silencer cartridge according to claim 2, wherein the packing density close to a central aperture of the cartridge is progressively reduced, as a function of the cartridge depth, towards the point of contact with the inside of the outer shell.

* * * * *